United States Patent [19]

Van Raemdonck

[11] 4,429,873

[45] Feb. 7, 1984

[54] TENNIS RACKET

[75] Inventor: Joris Van Raemdonck, Bazel, Belgium

[73] Assignee: Snauwaert En Depla N.V., Roeselare, Belgium

[21] Appl. No.: 292,246

[22] Filed: Aug. 12, 1981

[30] Foreign Application Priority Data

Aug. 13, 1980 [BE] Belgium ..... 201742

[51] Int. Cl.[3] ..... A63B 49/10; A63B 49/12

[52] U.S. Cl. ..... 273/73 F; 273/73 K; 273/DIG. 23; 273/DIG. 7; 156/79; 156/245; 264/46.6; 264/257

[58] Field of Search ..... 273/73 F, 73 K, 73 J, 273/80 R, 80 B, 80.9, DIG. 23, 73 C

[56] References Cited

U.S. PATENT DOCUMENTS

| | | | |
|---|---|---|---|
| 3,889,951 | 6/1975 | Schaefer et al. | 273/DIG. 23 |
| 4,070,019 | 1/1978 | Segal et al. | 273/DIG. 23 |
| 4,070,021 | 1/1978 | Cecka et al. | 273/73 F |
| 4,181,301 | 1/1980 | Cholat-Serpovd et al. | 273/73 F |
| 4,203,596 | 5/1980 | Nagamoto | 273/73 F |

FOREIGN PATENT DOCUMENTS

| | | | |
|---|---|---|---|
| 561488 | 10/1957 | Belgium | 273/73 F |
| 2057942 | 5/1971 | France | 273/73 F |
| 2115776 | 7/1972 | France | 273/73 F |
| 2187366 | 1/1974 | France | 273/73 F |
| 7307915 | 12/1973 | Netherlands | 273/73 F |
| 97305 | 1/1961 | Norway | 273/80 R |
| 450521 | 4/1935 | United Kingdom | 273/73 F |

OTHER PUBLICATIONS

Research Disclosure n° 117 Refers to Industrial Opportunities Ltd., Hampshire, U.K. Nr. 117, Jan. 1974.

*Primary Examiner*—Richard C. Pinkham
*Assistant Examiner*—Matthew Schneider
*Attorney, Agent, or Firm*—Fleit, Jacobson, Cohn & Price

[57] ABSTRACT

There is described a tennis racket the frame and shaft of which are formed by synthetic resin-impregnated fibres, such as glass and/or carbon fibres, aromatic polyamide or boron fibres, and the core both of the frame and the shaft is preferably filled with a synthetic foam with the purpose of determining the profile of those components formed by the fibres, in which inside the core is present at least in places in the frame and/or the shaft, at least one wood layer.

11 Claims, 3 Drawing Figures

Fig. 1
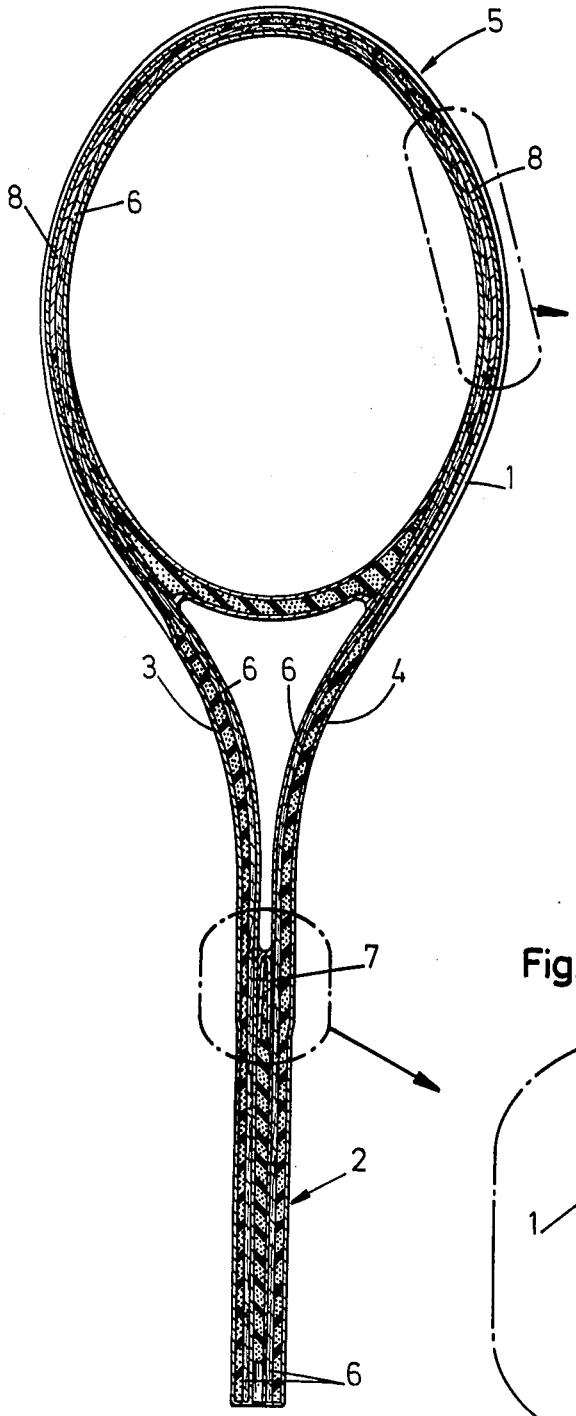
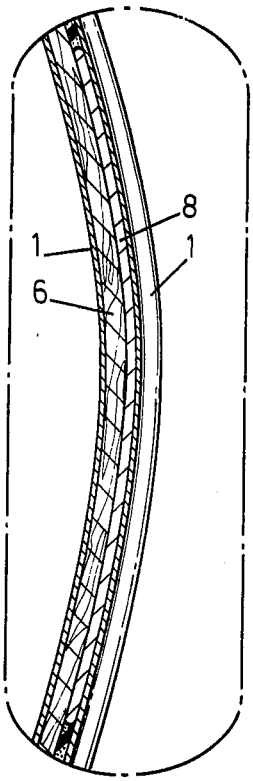
Fig. 2
Fig. 3
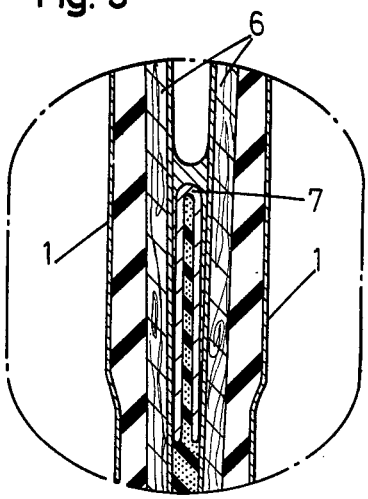

TENNIS RACKET

This invention relates to a tennis racket the frame and handle or shaft of which are comprised of synthetic resin-impregnated fibres such as glass and/or carbon fibres, aromatic polyamide or boron fibres, and the core of both frame and shaft is preferably filled with a synthetic foam for the purpose of determining the profile of those components formed by said fibres.

When manufacturing rackets of the above-defined type, that is rackets from glass and/or carbon fibres and similar, use is made of resins such as epoxy or polyester resins. The fibres bound by said resins are cured inside a mould. In said mould is generally fitted up to now a synthetic foam which has to determine the required profile of the "reinforcement" formed by the synthetic fibres.

Actually the synthetic foam thus forms a limit or boundary for the synthetic resin-impregnated fibres. The curing temperature of the unit lies in the range from 100°-180° C. under a pressure which may reach 20 kg/cm$^2$. The curing operation requires as a mean value some ten minutes.

The invention has for object to provide a tennis racket which is so designed that for a given stiffness and damping, the weight thereof is reduced, while trying at the same time to obtain a faster curing, in such a way that a larger production capacity becomes possible.

For this purpose, inside said core at least one wood layer is present at least in places inside said frame and/or shaft.

A feature of the invention lies in the core comprising at least in the shaft, at least in one place, and the frame, at least in two places, on either side of the geometric axis of the tennis racket, an insert from a material having a high specific weight.

Preferably said material having a high specific weight, is a heavy metal.

Other details and features of the invention will stand out from the following description given by way of non limitative example and with reference to the accompanying drawings, in which:

FIG. 1 is a lengthwise cross-section through a racket according to the invention.

FIGS. 2 and 3 show on a larger scale, two details from the racket according to the invention.

The racket according to the invention is formed by synthetic resin-impregnated fibres. Examples of suitable fibres are glass and/or carbon fibres, boron or aromatic polyamide fibres, or a combination from some fibres among said various fibres, while the synthetic resins used to bind said fibres are generally epoxy or polyester resins. The impregnated resins caused to cure inside a mould, form something which is generally called the "reinforcement" 1. To impart to said "reinforcement" the accurate shape thereof inside the mould, use is made of synthetic foam which is present inside the shaft 2 as well as inside the split legs 3 and 4 and the frame 5. The synthetic foam is thus used to determine the shape of said "reinforcement". The components arranged inside the mould are cured according to the standards prevailing up to now, as defined hereinabove, at a temperature from 100 to 180° C. and a pressure which may reach up to 20 kg/cm$^2$, during some ten minutes.

By making use of wood in the shape of a continuous layer 6, it is possible to remove already after some three minutes, the unit formed by the aggregates from the mould, while increasing the stiffness and the damping power of the tennis racket. Up to now, when the racket reinforcement did not contain any wood, neither the frame nor the shaft thereof was hardened enough after three minutes to be removed from the mould. This could only occur after about ten minutes, that is after enough cooling to prevent any distortion occuring in the racket when removing same from the mould.

Another advantage of importance may be considered in the total weight of the racket according to the invention, while retaining the required stiffness and damping power, being markedly lighter than in a racket the "reinforcement" of which is comprised exclusively of impregnated fibres.

An advantage of the racket the core of which is partly formed by a continuous or non continuous wood layer, thus lies for a substantial part in the saving in time and heat energy when curing.

Another advantage of no less importance, of the tennis racket according to the invention, is justified in the total weight of a tennis racket according to the invention being very light without said racket losing the required stiffness therof.

The weight of a tennis racket of the above-described type, lies in the range from 300 to 325 gr, depending on the specific weight of the wood layer.

Due to the very light weight of the tennis racket, it is then also possible to arrange in at least one place inside the shaft 2, an insert from heavy metal, such as lead or tungsten. In the example as shown in FIG. 3, said insert from heavy metal is of oblong U-shape.

In other places also, for example on either side of the geometric axis of the tennis racket, inserts 8 may be fastened inside the frame 5.

As the metal inserts 7 and 8 may be located selectively and as this occurs in a tennis racket the own weight of which was originally very light, the following three factors may be combined.

1 : the total racket weight may be determined very accurately;

2 : the center of gravity of said racket may be determined at will;

3 : the moment of inertia of said racket is substantially increased without harming the local stiffness of the racket.

The tennis player who handles a "feature-light racket" according to the invention, has the feeling he is playing with a wooden racket, a material which still has the preference now.

In spite of rackets from pure synthetic material having large advantages regarding shape, stability, higher fatigue resistance, etc., the preference of the great tennis players still go to wood, which material would insure a better play.

The tennis racket according to the invention thus combines the advantages of both tennis racket types. Moreover the racket according to the invention has the very substantial advantage of the racket center of gravity being movable at will according to the requirements, while said three factors do determine the center of percussion as well as the size of the so-called "sweet spot".

It is clear that the invention is in no way limited to the above embodiments and that many changes may be brought therein without departing from the scope of the invention as defined by the appended claims.

For instance the yoke formed by legs 3 and 4 might have another profile and be comprised exclusively of a thermoplastic material. The invention is naturally also not bound to a racket of the above-defined type; the shaft could be straight and have no yoke or Y-part.

Finally the wooden layer which is shown as a continuous element, may be provided both on the inner and outer side. The continuity of the wooden layer is not a requirement either. The wooden layer may be interrupted between frame and shaft and may also be present but in the one component.

I claim:

1. Tennis racket comprising:

a frame;

a shaft;

said frame and said shaft being formed by synthetic fibres or synthetic resin-impregnated fibres;

an inner core, made of synthetic foam, encompassed by said fibres and at least one wooden layer reinforcing said synthetic foam;

a one portion of side of said at least one wooden layer in contact with said fibres; and a portion of the other side of said at least one wooden layer in contact with said foam core.

2. Tennis racket as defined in claim 1, wherein said core comprises at least in the shaft of the tennis racket at least in one place an insert made of a material having a high specific gravity.

3. Tennis racket as define in claim 2, wherein said material having a high specific gravity is a heavy metal.

4. Tennis racket as defined in claim 1, wherein said frame comprises in at least two places on each side of the geometric axis of the racket inserts made of a material having a high specific gravity.

5. Tennis racket as defined in claim 4, wherein said material having a high specific gravity is a heavy metal.

6. Tennis racket as defined in claim 1, wherein said synthetic foam is a synthetic resin.

7. Tennis racket comprising a frame and a shaft;

a synthetic foam core determining a shape of said frame and said shaft;

at least one wooden layer reinforcing said foam core;

synthetic fibres or synthetic resin-impregnated fibres, encompassing said foam core and said at least one wooden layer, providing reinforcement for said tennis racket;

a portion of one side of said at least one wooden layer in contact with said fibres; and a portion of the other side of said at least one wooden layer in contact with said foam core.

8. Tennis racket according to claim 7, wherein said at least one wooden layer is continuous.

9. Tennis racket according to claim 7, further comprising an insert made of a material having a high specific gravity disposed in said shaft of said tennis racket.

10. Tennis racket according to claim 7, further comprising an insert made of a material having a high specific gravity disposed in said frame of said tennis racket on each side of the geometric axis of said tennis racket.

11. Tennis racket comprising a frame and a shaft;

a synthetic foam core determining a shape of said frame and said shaft;

at least one wooden layer reinforcing said foam core;

synthetic fibres or synthetic resin-impregnated fibres, encompassing said foam core and said at least one wooden layer, providing reinforcement for said tennis racket;

a portion of one side of said at least one wooden layer in contact with said fibres;

a portion of the other side of said at least one wooden layer in contact with said foam core;

a first insert of oblong U-shaped disposed in said shaft of said tennis racket; and a second and third insert disposed in said frame of said tennis racket on either side of the geometric axis thereof, said inserts having high specific weights, being positioned so as to determine the center of gravity of said racket, and substantially increasing the movement of inertia of said racket without adversely changing the local stiffness thereof.

* * * * *